US006604704B2

(12) United States Patent
Kiprowski

(10) Patent No.: US 6,604,704 B2
(45) Date of Patent: Aug. 12, 2003

(54) METHOD OF AND APPARATUS FOR MANIPULATING BOBBINS

(75) Inventor: Carsten Kiprowski, Neustadt-Glewe (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 110 days.

(21) Appl. No.: 09/838,262

(22) Filed: Apr. 20, 2001

(65) Prior Publication Data

US 2001/0045490 A1 Nov. 29, 2001

(30) Foreign Application Priority Data

May 25, 2000 (DE) ..... 100 25 848

(51) Int. Cl.[7] ..... B65H 19/00
(52) U.S. Cl. ..... 242/559.1; 242/559; 414/911
(58) Field of Search ..... 242/559, 559.1, 242/533.2, 533.3, 533; 414/911

(56) References Cited

U.S. PATENT DOCUMENTS

| | | | | |
|---|---|---|---|---|
| 4,412,505 A | | 11/1983 | Hausler et al. | |
| 4,805,641 A | | 2/1989 | Radzio et al. | |
| 4,840,321 A | * | 6/1989 | Focke et al. | 242/559.1 |
| 5,035,571 A | | 7/1991 | Raasch | |
| 5,135,008 A | | 8/1992 | Oesterling et al. | |
| 5,205,505 A | | 4/1993 | Focke et al. | |
| 5,249,757 A | | 10/1993 | Draghetti et al. | |
| 5,289,985 A | | 3/1994 | Cocchi et al. | |

FOREIGN PATENT DOCUMENTS

| | | |
|---|---|---|
| DE | 38 16 164 | 11/1989 |
| DE | 40 24 284 A1 | 2/1992 |
| DE | 41 42 256 A1 | 6/1992 |
| DE | 40 41 865 C2 | 7/1992 |
| DE | 42 34 344 A1 | 5/1993 |
| DE | 43 41 925 | 6/1995 |
| DE | 692 08 504 T2 | 10/1996 |
| DE | 195 38 392 | 4/1997 |
| DE | 198 06 432 A1 | 8/1999 |
| EP | 0 744 363 A2 | 11/1996 |
| GB | 2 244 983 A | 12/1991 |

* cited by examiner

*Primary Examiner*—John Q. Nguyen
(74) *Attorney, Agent, or Firm*—Venable, LLP; Robert Kinberg

(57) ABSTRACT

Bobbins containing convoluted webs of sheet material, particularly wrapping material for smokers' products, are transferred from a stack—wherein the axes of the cores of bobbins are vertical—onto the horizontal stub of a receiver in a web processing machine by an apparatus wherein a first set of jaws serves to engage the core of a fresh bobbin from within preparatory to transfer to the receiver and simultaneous pivoting of the first set of jaws through 90°. When the supply of web on the core borne by the stub of the receiver is exhausted, the external surface of the thus exposed core is engaged by a second set of jaws which transport the core to a collecting station or the like. Sheet-like partitions which are disposed between neighboring layers of fresh bobbins in the stack are removed by suction cups which are mounted on a reciprocable pusher together with the jaws of the second set.

17 Claims, 9 Drawing Sheets

15
11
Z
12
1
26
27
24
24
27
19
23
28
28
23
13
14

METHOD OF AND APPARATUS FOR MANIPULATING BOBBINS

CROSS-REFERENCE TO RELATED CASES

The present application claims the priority of the commonly owned copending German patent application Serial No. 100 25 848.4 filed May 25, 2000. The disclosure of the above-referenced German patent application, as well as that of each US and foreign patent and patent application identified in the specification of the present application, is incorporated herein by reference.

BACKGROUND OF THE INVENTION

The invention relates to improvements in apparatus for and in methods of manipulating commodities which constitute facilities for storage of webs or strips of sheet material, such as paper, lightweight cardboard, metallic foil, plastic foil or the like. More particularly, the invention relates to improvements in methods of and in apparatus for manipulating reels, bobbins or analogous devices for temporary storage of convoluted webs or strips of paper, cardboard, metallic foil, plastic foil or other wrapping material, particularly a material which can be utilized in connection with the making and processing (such as packing) of cigarettes, filter rod sections or other smokers' products.

It is customary to stack substantial numbers of bobbins or reels containing supplies of convoluted webs or strips of cigarette paper, uniting band paper, wrapping paper or the like at a machine which is utilized to convert the convoluted webs or strips (hereinafter called webs) into discrete blanks or into tubular envelopes for rod-like fillers of tobacco, filter material for tobacco smoke or the like. In many instances, the stacks of reels or bobbins (hereinafter called bobbins) are stored in the form of superimposed horizontal layers wherein the axes of the cores of bobbins extend vertically or substantially vertically. Neighboring layers of bobbins are often separated from each other by sheets of paper or the like. Apparatus for transferring successive fresh bobbins from the stack to a bobbin receiver of the making, packing or other web processing machine must be capable of changing the orientation of the bobbin during transfer between the stack and the machine because, in many or most instances, the receiver of the machine is positioned to support a bobbin in such orientation that the axis of the core of the bobbin which is ready to pay out the convoluted web is horizontal. This holds true for cigarette making, filter cigarette making, cigarette packing and many other types of machines which employ webs of paper or paper-like material.

German patent No. 40 41 865 discloses an apparatus which can change the orientation of the axis of a bobbin from vertical to horizontal during transport from a stack of bobbins (e.g., on a pallet) to a receiver for discrete bobbins. A drawback of the patented apparatus is that it takes up a substantial amount of space if used in a cigarette making and/or processing (such as tipping or packing) machine as well as that the patented apparatus must employ several multiaxial linear drives which contribute to the cost and bulk of such apparatus.

European patent No. 0 744 363 A2 discloses an apparatus which is designed to remove sheets, panels, mats or analogous partitions separating superimposed layers of blanks which are utilized in connection with the making of so-called hinged-lid cigarette packs. The partition-removing implement includes a gripping device which carries suction-operated pads for successive partitions and presser elements for stacked U-shaped blanks of the type used in so-called hinged-lid cigarette packs, and is movable by a linkage to transfer successive partitions from their horizontal planes at the bobbin stacking station into vertical planes within a suitable collecting receptacle.

OBJECTS OF THE INVENTION

An object of the present invention is to provide a simple, compact and relatively inexpensive but highly reliable apparatus for transporting and simultaneously changing the orientation of successive bobbins containing convoluted webs during transport between a stacking station and the receiver of a web processing or consuming machine.

Another object of the invention is to provide a web manipulating apparatus whose efficiency is superior to that of presently known apparatus and which can be utilized for the manipulation of all or practically all presently known types or sizes of bobbins for storage of convoluted webs or strips of paper or the like.

A further object of the instant invention is to provide an apparatus which can accept and process many or all presently knwn and available bobbins for storage of convoluted wrapping or packing material for cigarettes, cigarette packs, filter rod sections and the like.

An additional object of the present invention is to provide a novel and improved method of reducing the joint space requirements of a web consuming machine (such as a machine for making rod-shaped smokers' products) and a magazine for temporary storage of stacked bobbins.

Still another object of the invention is to provide a novel and improved bobbin lifting and reorienting assembly for use in the above outlined apparatus.

A further object of the invention is to provide a novel and improved method which can be practiced to supply bobbins or reels for storage of convoluted webs of sheet-like wrapping material to existing cigarette making, cigarette packing, cigarette pack cartoning, cigarette pack sealing and/or other machines which are utilized in the tobacco processing industry and/or in other fields.

Another object of the invention is to provide a versatile apparatus which is capable of manipulating fresh bobbins and spent bobbins as well as other commodities such as partitions which are interposed between superimposed layers of fresh bobbins.

SUMMARY OF THE INVENTION

One feature of the present invention resides in the provision of an apparatus for transferring discrete bobbins (especially fresh bobbins) of the type wherein a web of flexible sheet material is convoluted around the external surface of a hollow core further having an internal surface which is coaxial with the external surface of the core. The transfer is to be carried out from a stack of superimposed layers of bobbins having a first orientation to a receiver whereon a bobbin has a different second orientation. The layers of the stack are or can be separated from each other by sheet- or mat-like partitions of paper, plastic material or the like. The improved apparatus comprises a first gripper having first jaws receivable in the core of a bobbin and means for moving the jaws relative to the axis of the bobbin into and from engagement with the internal surface of such core, a second gripper having second jaws movable to positions adjacent the external surface of a core and means for moving the second jaws into and from engagement with the external surface of such core, suction-operated lifting means for attracting a partition upon removal of a layer of fresh bobbins from the stack, means for moving the grippers and the lifting means between the stack and the receiver, and means for changing the orientation of the grippers.

The webs can consist of a wrapping material for smokers' products.

The orientation changing means can include means for pivoting the grippers, and preferably also the lifting means, through an angle of 90° or at least close to 90°.

As a rule, or at least in many instances, the axes of the fresh bobbins in the stack are at least substantially vertical and the axis of a fresh or expiring or expired (exhausted) bobbin on the receiver is at least substantially horizontal.

At least one of the grippers can comprise an array of at least three at least substantially equidistant jaws or claws.

The arrangement is or can be such that the first jaws are movable at least substantially radially of the axis of a core into engagement with the internal surface of such core at the stack (i.e., of a core forming part of a fresh bobbin) and from engagement with the internal surface of a core at the receiver (i.e., of a core forming part or constituting the remnant of an expired or exhausted bobbin). Such apparatus can further comprise a substantially plate-like pusher and means (e.g., a fluid-operated cylinder and piston unit) for moving the pusher relative to the first jaws at least substantially axially of the core being engaged by the first jaws while the respective core is being transported from the stack to the receiver. The arrangement is or can be such that the first jaws are movable into the interior of the core of a bobbin at the stack through a predetermined distance and the pusher is movable relative to the first jaws through a second distance which matches or approximates the first distance. The partition-lifting means is or can be movable with the pusher, and the second jaws are borne or can be mounted on the pusher. In accordance with a presently preferred embodiment, the second jaws are movable against the external surface of the core forming part of an exhausted or expired bobbin at the receiver by moving substantially radially of such external surface, and away from the core of an exhausted bobbin at a location which is or which can be remote from the receiver as well as from the stack and which can serve as a dump for exhausted bobbins.

The receiver is or can be associated with or can form part of a cigarette packing machine, of a cigarette making machine, of a tipping (filter cigarette making) machine, of a filter rod making machine or of any other machine which consumes or processes convoluted webs of paper, foil or the like.

The apparatus can comprise a common mobile support or carrier for the grippers and for the lifting means.

Another feature of the present invention resides in the provision of a method of manipulating bobbins of the type including a hollow core having coaxial internal and external surfaces and a web of convoluted sheet material surrounding the external surface of the core. The improved method comprises the steps of establishing a stack of a plurality of superimposed at least substantially horizontal layers of fresh bobbins wherein the bobbins have at least substantially vertical axes and wherein the superimposed layers are separated from each other by at least substantially horizontal sheet- or mat-like partitions, gripping the internal surfaces of cores at the stack and transferring the thus gripped cores (i.e., the respective fresh bobbins) from the stack to a web processing station (e.g., to the horizontal stub-like receiver of a cigarette making, packing or other machine), changing the orientation of the axes of the bobbins from at least substantially vertical to at least substantially horizontal during transfer from the stack to the processing station, gripping the external surface of the core of an expired or exhausted bobbin at the processing station and removing such core from the station, and lifting a partition off the stack upon completed transfer of a layer of bobbins from the stack to the processing station.

The method can further comprise the step of changing the orientation of the partition (e.g., from at least substantially horizontal to vertical or substantially vertical) upon lifting of the partition off the stack of fresh bobbins.

The gripping steps are or can be carried out by sets or arrays of equidistant jaws or claws, and the movements of jaws which carry out the transfer of fresh bobbins from the stack to the processing station can be shared by grippers which carry out the aforementioned removing step.

The method can further comprise the step of converting the webs of bobbins at the processing station into discrete wrappers of smokers' products.

Still further, the method can comprise the step of transferring lifted partitions from the stack into a suitable collecting receptacle; such transfer can involve a change of orientation of lifted partitions on their way toward or at the collecting receptacle.

The method can further comprise the step of supporting the core of the fresh, expiring or exhausted bobbin at the processing station from within.

The novel features which are considered as characteristic of the invention are set forth in particular in the appended claims. The improved apparatus itself, however, both as to its construction and the modes of assembling, installing and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
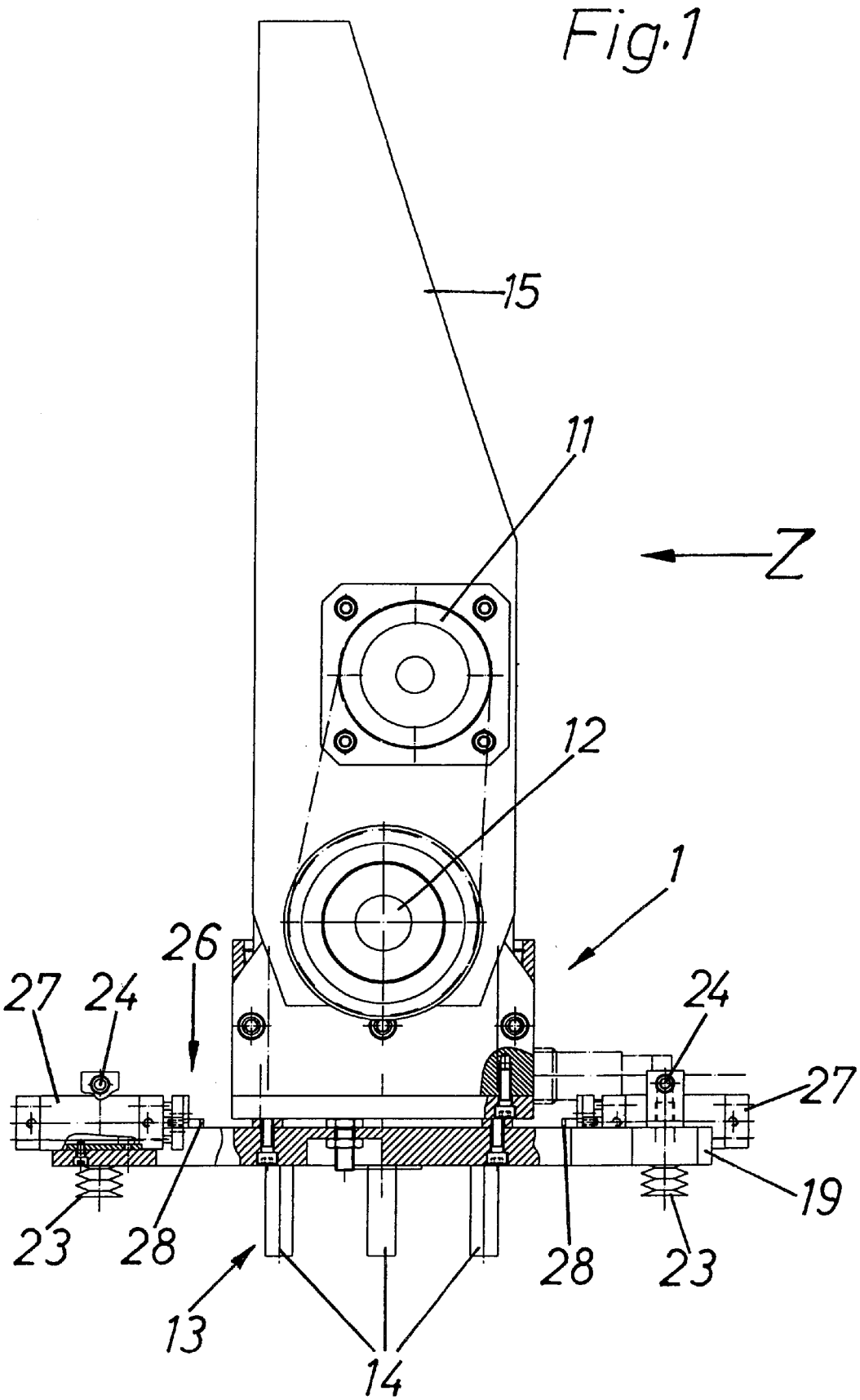
FIG. 1 is a partly elevational and partly vertical sectional view of a bobbin transporting and reorienting apparatus which embodies one form of the present invention and which is combined with means for disposing with exposed partitions at the stack of fresh bobbins.
Figure 2:
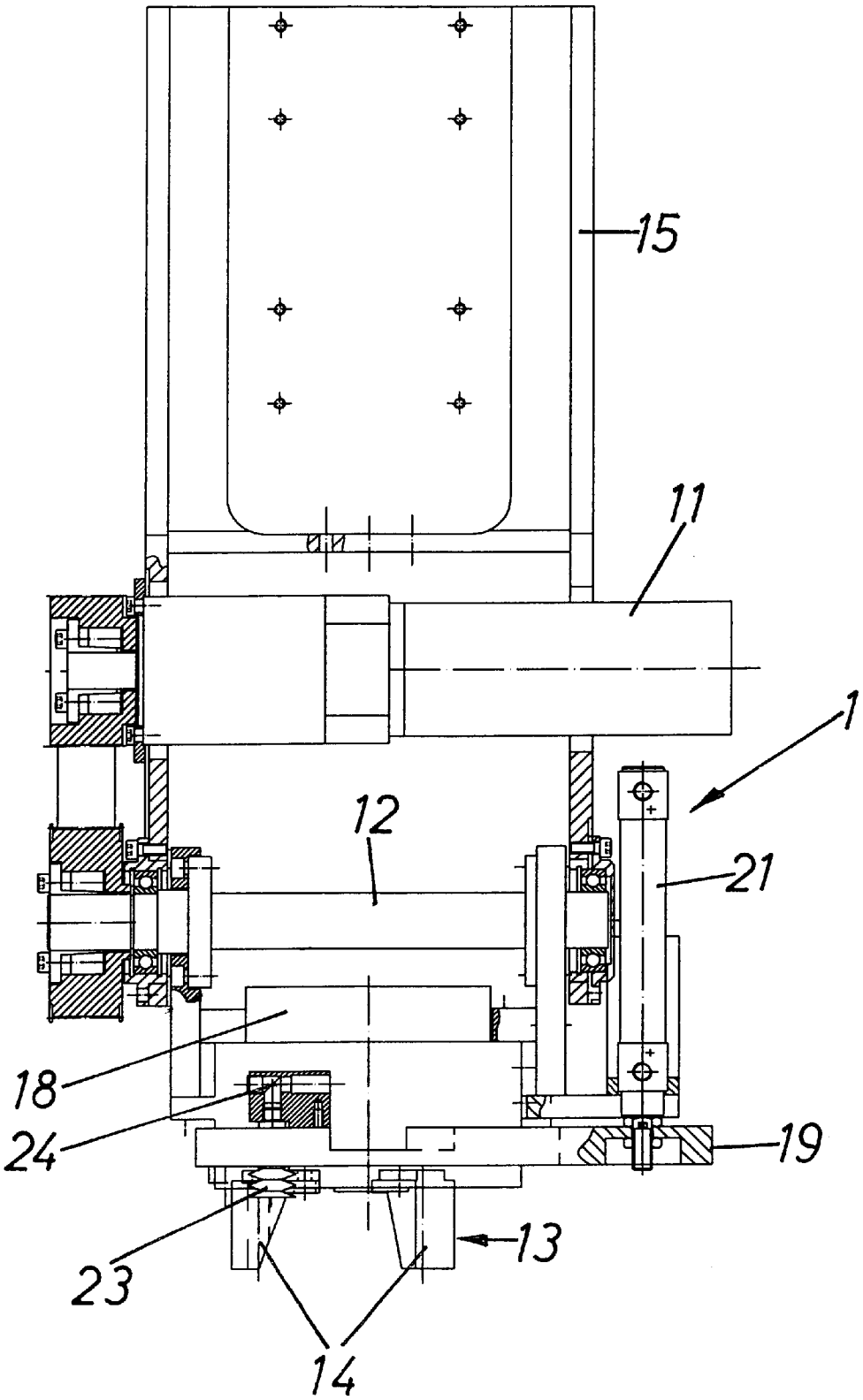
FIG. 2 is a view as seen in the direction of arrow Z shown in FIG. 1, with certain parts of the apparatus shown in vertical section.
Figure 3:
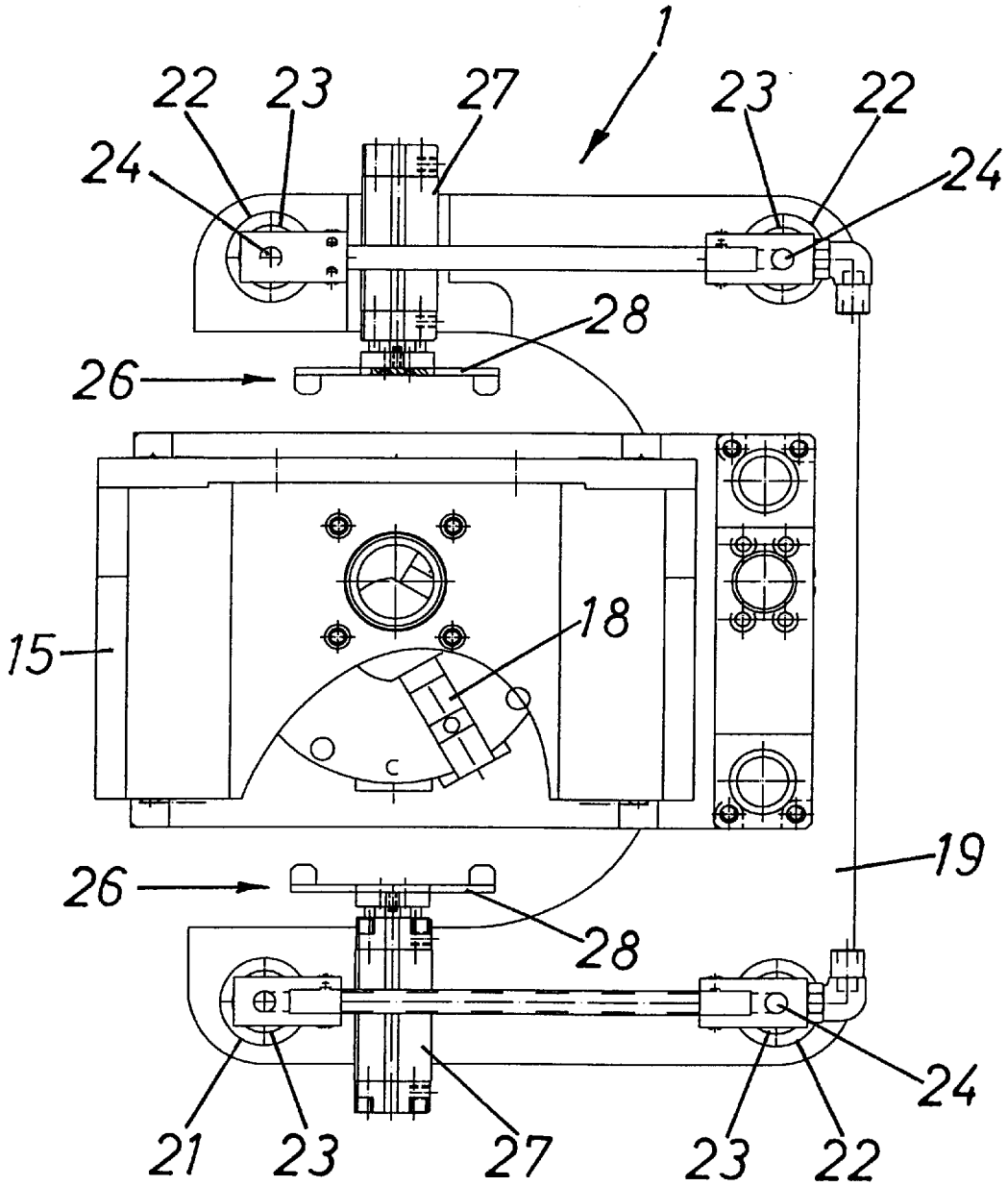
FIG. 3 is a plan view of the apparatus which is shown in FIGS. 1 and 2.

The apparatus 1 which is shown in FIGS. 1 to 3 serves to transport and to simultaneously change the orientation of fresh bobbins 17 between a stack 8 of bobbins on a pallet 7 (see FIG. 4) and a horizontal receiver or support 9 accessible at the front side of a web consuming or processing machine 10, e.g., a machine known as C 90 film wrapper which serves to wrap individual so-called soft or hinged-lid cigarette packs into transparent film. To this end, the machine 10 repeatedly severs the leader of the web 20 on the core 16 of a fresh or partly expired bobbin on the horizontal projection or stub or stud 9*a* of the receiver 9 to form a series of discrete blanks which are thereupon draped around discrete cigarette packs. C 90 film wrappers are distributed by the assignee of the present application.

Figure 4:
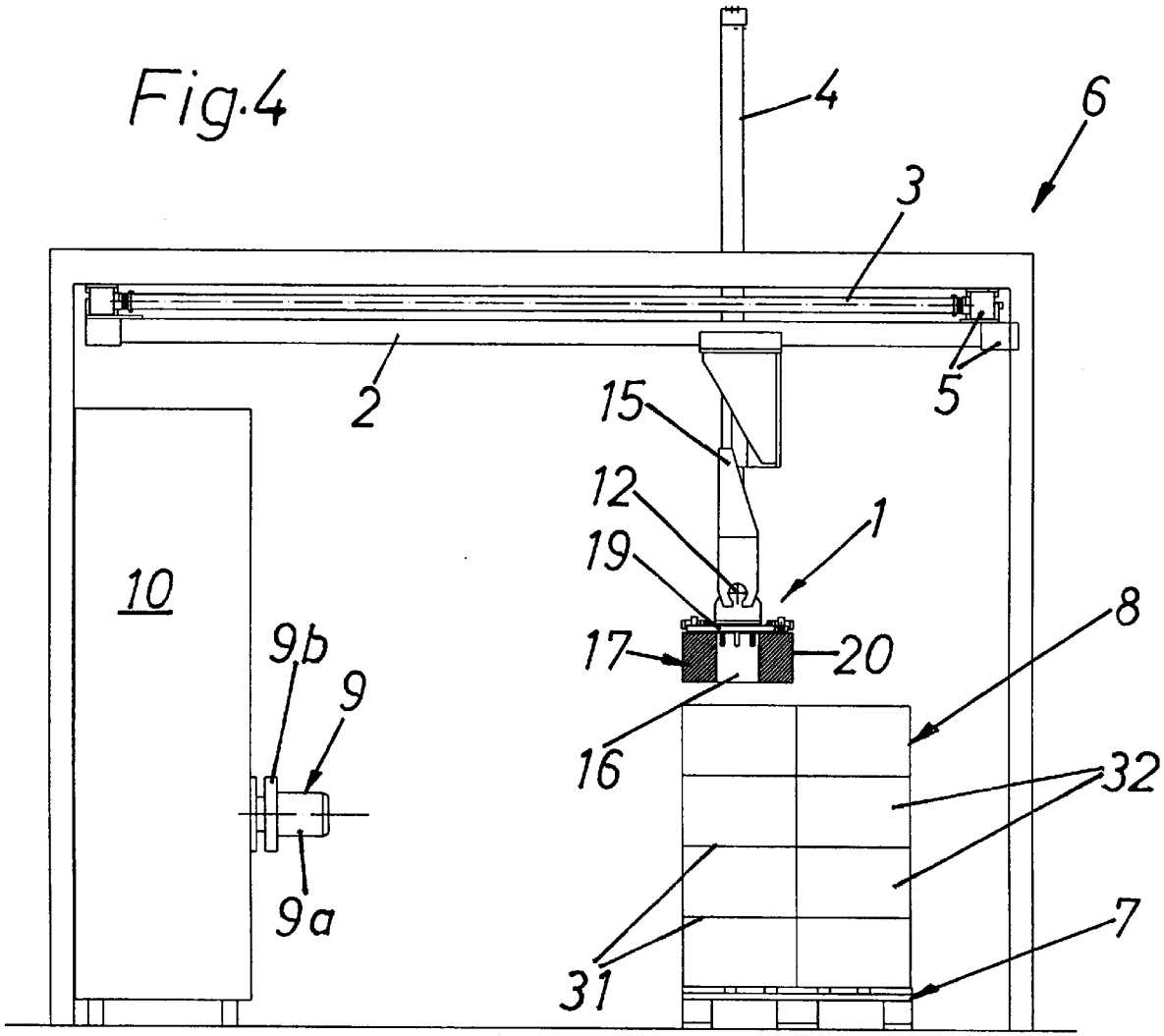
FIG. 4 shows the apparatus in a side elevational view drawn to a smaller scale and in the process of lifting a fresh bobbin from the stack of bobbins prior to transfer onto the receiver of a web processing or consuming machine and with simultaneous change of orientation of the fresh bobbin.
Figure 10:
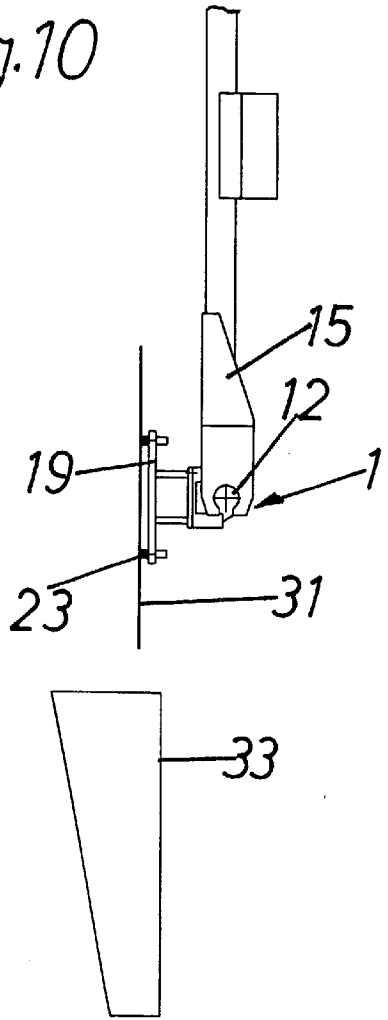
FIG. 10 illustrates the apparatus, with a partition attracted by the suction-operated lifting means, above a collecting receptacle for partitions.

FIG. 4 further shows a portal or gate 6 which includes longitudinal guide means 2, transverse guide means 3 and upright guide means 4 for the apparatus 1. The latter can be moved along such guide means by motor means 5 to transport fresh bobbins 17 from the stack 8 to the receiver 9 (see FIGS. 5 and 6), to transport spent bobbins (i.e., their cores 16) from the receiver 9 to a collecting or evacuating station (FIGS. 7 and 8), to transport separating mats or sheets (partitions) 31 from the stack 8 on the pallet 7 to a collecting receptacle 33 (FIGS. 9 and 10) and to perform (if necessary) additional tasks relating to the manipulation of bobbins 17 and related or associated parts or groups of parts.

The apparatus 1 is turnable through 90° about the axis of a horizontal shaft 12 by a gearmotor 11 (see FIGS. 1 and 2) and comprises a first gripper 13 having three clamping jaws or claws 14 offset relative to each other through angles of 120°. The jaws 14 are arranged to enter the interior of the hollow cylindrical core 16 of a fresh bobbin 17 and to thereupon move apart to thus grip the internal surface of the core (see, for example, FIG. 4) in order to lift a fresh bobbin 17 off the stack 8 and to thereupon transport the bobbin to the receiver 9 of the machine 10.

The means for moving the jaws 14 of the gripper 13 relative to each other comprises a fluid-operated (preferably pneumatic) motor 18 (see FIGS. 2 and 3).

The apparatus 1 further comprises a substantially U-shaped plate-like pusher 19 which is movable along guide rods 22 relative to the jaws 14 by a pneumatic cylinder and piston unit 21. The pusher 19 carries four suction-operated attracting devices (suction cups) 23 which can be connected to a suction generating device (not shown) by one or more conduits 24.

The pusher 19 further carries a second gripper 26 having two jaws 28 which are disposed diametrically opposite each other and can be actuated by discrete motors 27 (such as pneumatic cylinder and piston units) which cause the jaws 28 to engage the external surface of the core 16 of a spent (i.e., exhausted) bobbin. This can be seen in FIGS. 7 and 8 where the jaws 28 are shown in the process of removing an empty bobbin (i.e., a bobbin which merely comprises its core) from the stub 9*a* of the receiver 9.

The reference character 15 denotes a common support or carrier which forms part of the apparatus 1 and mounts the gripper 13, the pusher 19 and the suction cups 23 and the gripper 26 thereon, as well as the means 11, 12 for changing the orientation of successive fresh bobbins 17 during transport from the stack 8 to the stub 9*a* of the receiver 9.

The mode of operation of the apparatus 1 is as follows:

In order to transfer a fresh bobbin 17 from the stack 8 on the pallet 7 in the portal 6 of FIG. 4 onto the stub 9*a* of the receiver 9 of the machine 10, the plate-like pusher 19 is retracted and the jaws 14 of the gripper 13 are caused to enter the interior of the core 16 of the uppermost bobbin 17 (or one of two or more uppermost bobbins) at the top of the stack 8. As can be seen in FIG. 4, the jaws 14 are relatively short so that they enter only the upper part of the interior of the core 16 of the selected accessible bobbin 17. The fluid-operated motor 18 is then caused to move the jaws 14 apart so that they bear upon the internal surface of the core 16 with a force which is required to lift the thus engaged fresh bobbin 17 off the stack 8.

The next step involves starting the motor means 5 for moving the apparatus 1 upwardly with and/or relative to the vertical guide 4 so that the selected fresh bobbin 17 is lifted to or above the level shown in FIG. 4 prior to moving along the horizontal guide 2 and/or 3 toward the receiver 9.

Figure 5:
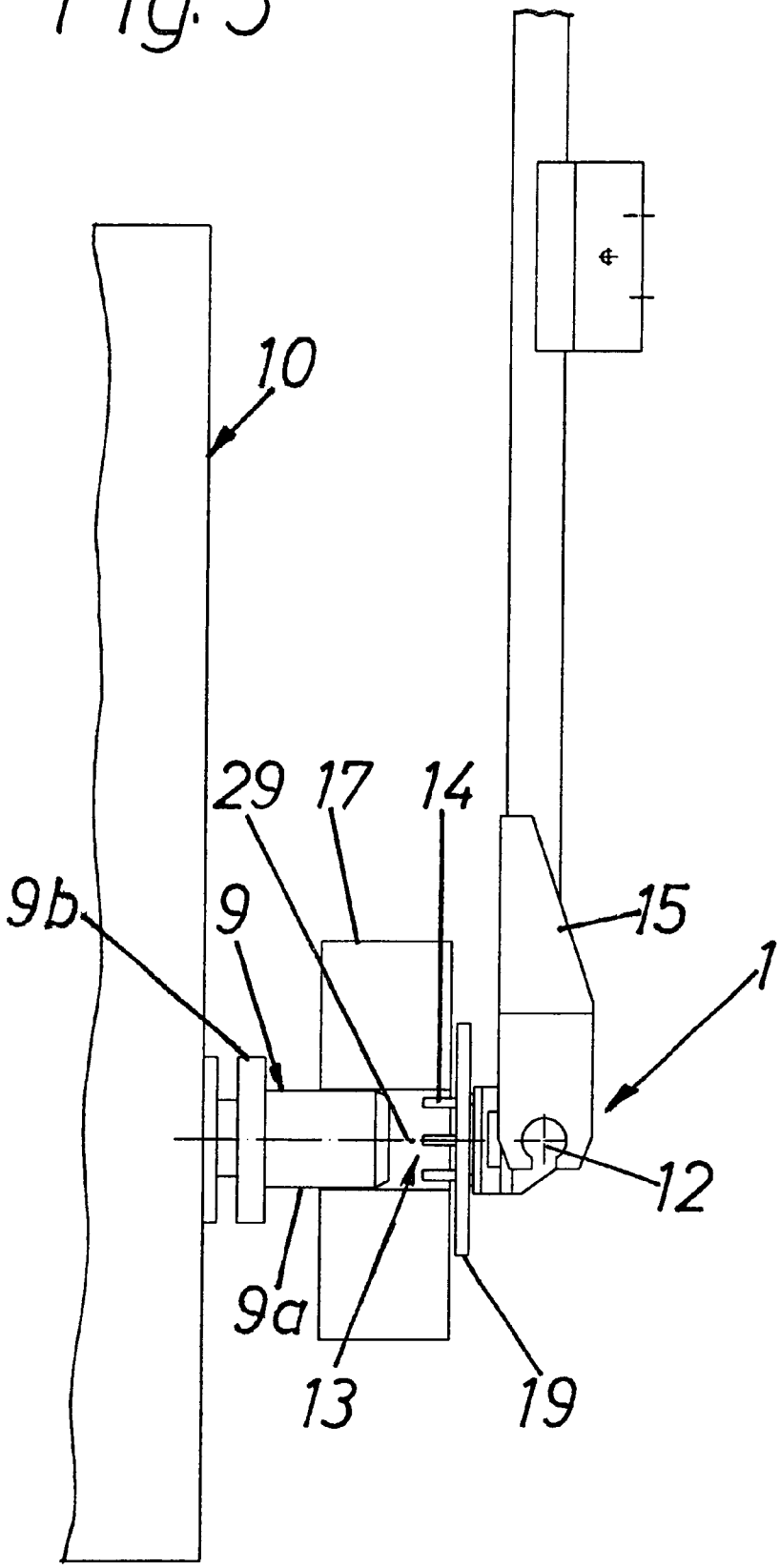
FIG. 5 illustrates the apparatus during slipping of the core of a fresh bobbin onto the horizontal stub of a receiver at the web processing or consuming station.

The gearmotor 11 is started to turn the gripper 13 and the raised bobbin 17 through 90° about the axis of the shaft 12 (in a clockwise direction, as viewed in FIG. 4) so that the axis of the bobbin is parallel to the horizontal axis of the stub 9*a* of the receiver 9, i.e., as soon as the orientation changing means 11, 12 of the apparatus 1 has completed the task of changing the orientation of the axis of the lifted fresh bobbin 17 from vertical (FIG. 4) to horizontal (FIG. 5). This results in penetration of a portion of the receiver's stub 9*a* into the core 16 being held by the jaws 14.

Figure 6:
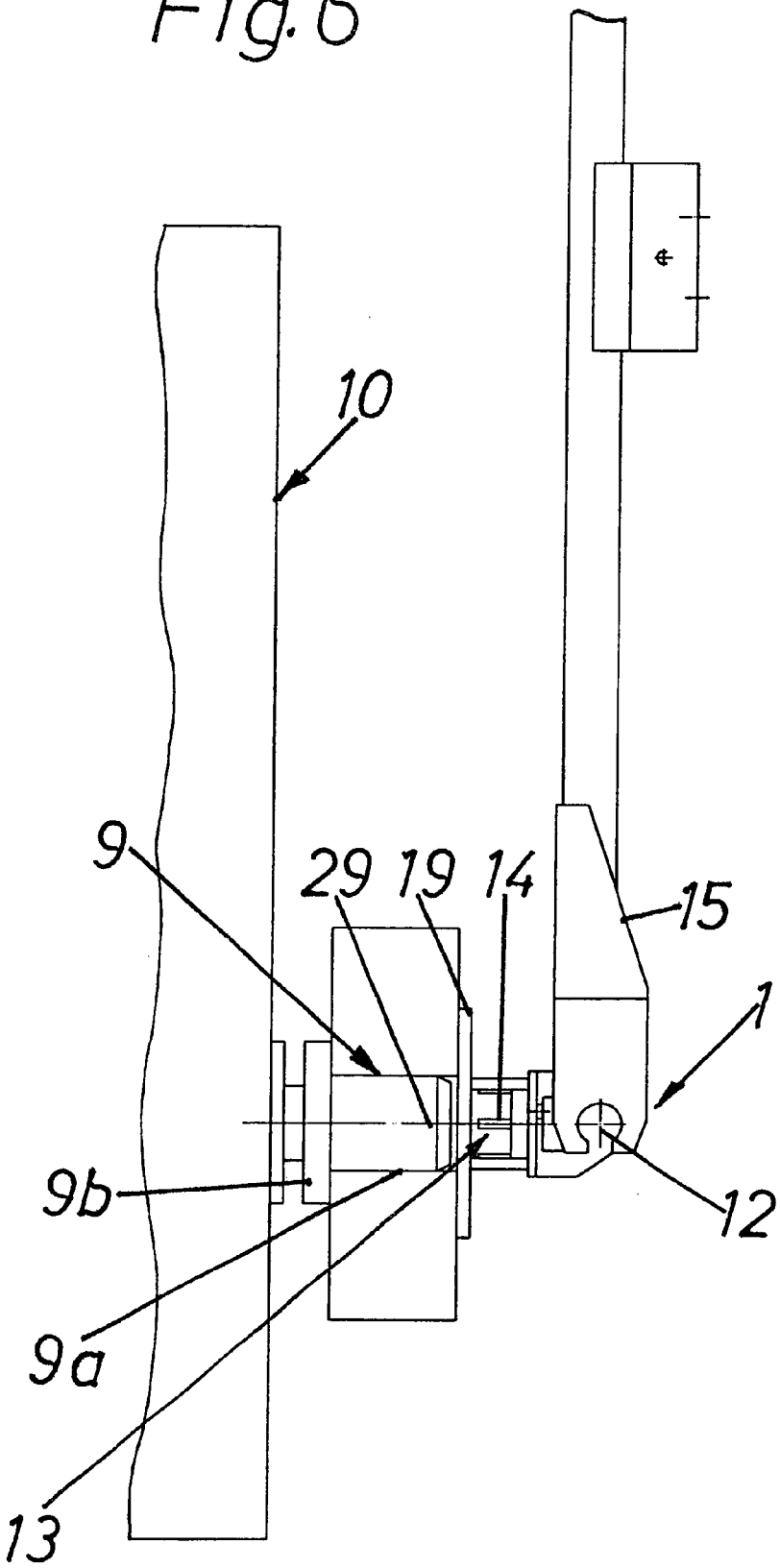
FIG. 6 illustrates the structure of FIG. 5 but with the apparatus in the process of moving away from the freshly transferred and reoriented bobbin on the stub of the receiver.

The jaws 14 are thereupon retracted radially inwardly from the internal surface of the core 16 on the stub 9*a* of the receiver 9, and the pusher 19 is moved from the position of FIG. 5 to that shown in FIG. 6 so that the bobbin 16 is supported solely by the stub 9*a*.

The means for moving the pusher 19 includes the cylinder-and-piston unit 21. FIG. 6 shows that the pusher 19 further serves to move the core 16 of the bobbin 17 off the jaws 14 while pushing such core all the way toward and against a stop 9*b* of the retainer 9. A suitable spring-biased click or the like can be employed to releasably hold the core 16 in the axial position of FIG. 6 while the bobbin 17 discharges the supply of convoluted web 20 for processing or consumption in the machine 10.

Figure 7:
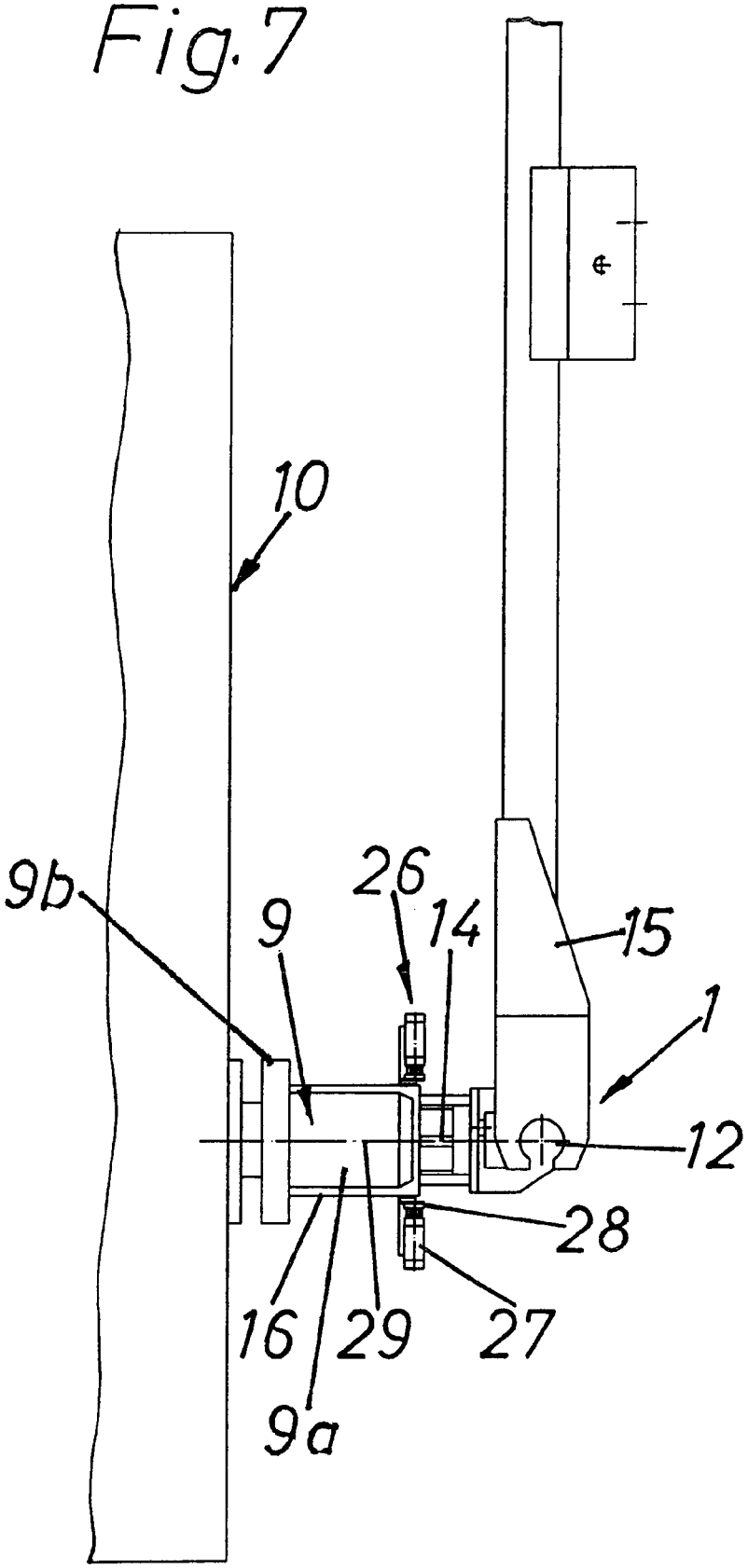
FIG. 7 illustrates the improved apparatus during an initial stage of removal of an exhausted (empty) bobbin from the receiver.
Figure 8:
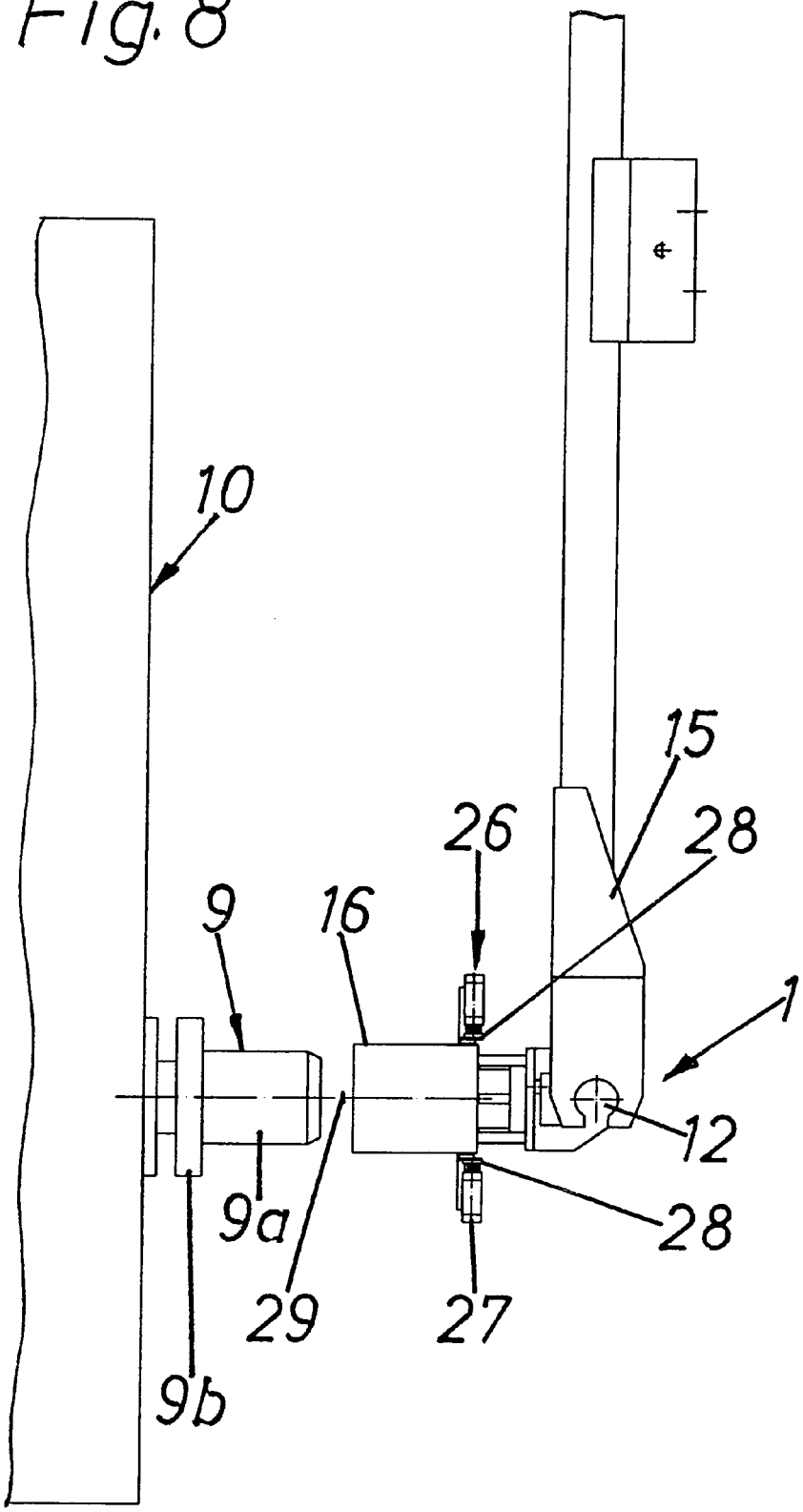
FIG. 8 shows the structure of FIG. 7 but with the core separated from the receiver.

The mode of operation of the improved apparatus when it is utilized to remove an empty (spent or exhausted) bobbin from the receiver 9 is as follows:

The apparatus 1 is moved to the position of FIG. 7 in which the axis 29 of the stub 9*a* of the receiver 9 coincides with the axis of the gripper 26 and with the jaws 28 of the gripper 26 spaced apart so that they are outwardly adjacent the core 16 on the stub 9*a*. The pusher 19 is held in the extended position. The cylinder-and-piston unit 27 is thereupon caused to move the jaws 28 against the external surface of the core 16 (see FIG. 7), and the apparatus 1 is caused to move away from the receiver 9 (see FIG. 8) so that the core 16 is moved axially and away from the stub 9*a*.

Figure 9:
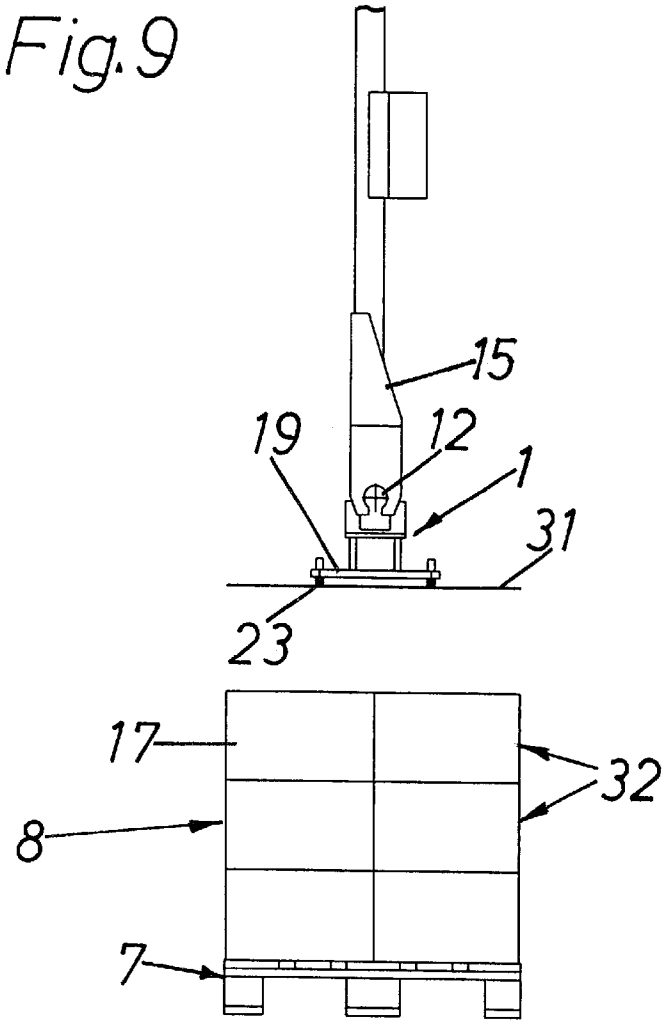
FIG. 9 illustrates the apparatus in a position similar to that shown in FIG. 4 but in the process of lifting a partition off the topmost layer of bobbins in the stack.

In order to remove a partition or sheet 31 from the stack 8, the apparatus 1 is moved to a level above the stack (see FIG. 9). The upper side of the topmost partition 31 is exposed and accessible upon removal of the second of a pair of coplanar fresh bobbins 17 (i.e., of a complete layer 32 of fresh bobbins) on the pallet 7. The pusher 19 is held in the extended position and the suction cups 23 on this pusher contact and attract the upper side of the accessible topmost partition or sheet 31. The apparatus 1 is thereupon lifted to the position of FIG. 9 (or even slightly above such position) so that the lifted partition 31 can be caused to change its orientation by 90° prior to movement of the apparatus 1 to the position of FIG. 10, namely to a level above a collecting receptacle 33 for partitions 31. The suction cups 23 are disconnected from the suction generating device and the partition 31 is free to enter the receptacle 33 by gravity. The apparatus 1 can remain in the position of FIG. 10 until it is again called upon to remove a core 16 from the stub 9*a* or to transfer a fresh bobbin from the stack 8 onto the stub 9*a*.

The exact construction of the preferably automatic controls for the apparatus 1 forms no part of the present invention. The operation of such apparatus can be automated to any desired extent, and the controls can include suitable monitoring devices which monitor the quantity of convoluted web 20 on the core 16 of the bobbin 17 on the stub 9*a*, the orientation of the gripper 13 relative to the axis of the shaft 12 and other parameters which must be taken into consideration prior to carrying out of the next step.

An important advantage of the improved apparatus 1 is that it is more versatile than heretofore known apparatus for manipulating empty and fresh bobbins in cigarette making and other machines. Furthermore, the improved apparatus occupies a surprisingly small amount of space and can be caused to operate in conjunction with existing machines which process webs or strips of paper, foil or the like, e.g., to make rod-shaped articles of the tobacco processing industry, to make packs of cigarettes or the like, to confine arrays of cigarette packs or the like in so-called cartons, or to manipulate fresh and empty bobbins in or in conjunction with machines other than those utilized in the tobacco processing industry.

FIG. 1 of U.S. Pat. No. 4,412,505 (granted Nov. 1, 1983 to Hausler et al. for "APPARATUS FOR APPLYING ATOMIZED LIQUID TO A RUNNING LAYER OF FILAMENTARY MATERIAL OR THE LIKE") shows a bobbin 18 which is mounted on the front wall of the frame of a filter rod making machine and serves to supply a continuous web of wrapping material to a station where the web is draped around a continuous tow of filter material for tobacco smoke. Such bobbins can be supplied by an apparatus which embodies the present invention. The same applies for the expiring bobbin 24 and a fresh bobbin shown in the upper left-hand portion of FIG. 1 in commonly owned U.S. Pat. No. 5,135,008 granted Aug. 4, 1992 to Oesterling et al. for "METHOD OF AND APPARATUS FOR MAKING FILTER CIGARETTES"; these bobbins store supplies of webs which are utlized to connect plain cigarettes with filter rod sections to form filter cigarettes. FIG. 1 of commonly owned U.S. Pat. No. 4,805,641 (granted Feb. 21, 1989 to Radzio et al. for "METHOD AND APPARATUS FOR ASCERTAINING THE DENSITY OF WRAPPED TOBACCO FILLERS AND THE LIKE") shows an expiring bobbin 22 and a fresh bobbin of convoluted cigarette paper which is fed to the wrapping station of a cigarette making machine. Such bobbins, too, can be supplied by the apparatus embodying the present invention.

Certain further important advantages of the improved apparatus are its compactness and versatility as well as the small dimensions of the space which is required by the apparatus to perform its numerous functions including supplying fresh bobbins 17 from the stack 8 to the receiver 9, properly mounting successive fresh bobbins on the stub 9*a* of the receiver 9, removing spent or exhausted bobbins (i.e., cores 16 with exposed external surfaces) from the web processing station accommodating the machine 10 and its receiver 9, removing successive fully exposed partitions 31 from the topmost intact layer 32 of fresh bobbins in the stack 8, and delivering removed partitions 31 to the collecting receptacle 33.

An advantage of the radially movable jaws 14 and 28 is that they can properly engage the internal and external surfaces of cores 16 having small, medium-sized or relatively large diameters. Three inner jaws 14 and two outer jaws 28 suffice to properly center the cores 16 of a fresh bobbin 17 on the stub 9*a* of the receiver 9 or to properly engage a core 16 preparatory to removal from the stub 9*a*. Moreover, three jaws 14 (especially three equidistant jaws 14) suffice to ensure predictable and reliable change of orientation of successive filled bobbins 17 on their way from the stack 8 to the stub 9*a* of the receiver 9.

An important advantage of the shiftable (reciprocable) pusher 19 and of the feature that the suction cups 23 as well as the jaws 28 of the second set (i.e., of the gripper 26) are mounted on and share the movements of the pusher 19 is that the linear drives 5 which serve to move the apparatus 1 along the guide 2, 3 and/or 4 need not be actuated to engage the jaws 28 with or to disengage such jaws from the external surface of a core 16, i.e., from an expired or exhausted bobbin; all that is necessary is to operate the adjusting cylinder 21 for the pusher 19 and/or the cylinders 27 for the jaws 28. This simplifies the operation of the improved apparatus and contributes to a reduction of energy requirements and more rapid completion of removal of and dispensing with the exhausted bobbins.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating bobbins of convoluted wrapping material and, therefore, such adaptations should and are intended to be comprehended within the meaning and range of equivalence of the appended claims.

What is claimed is:

1. Apparatus for transferring discrete bobbins of the type wherein a web of flexible material is convoluted around the external surface of a hollow core further having an internal surface coaxial with the external surface from a stack of superimposed layer of bobbins having a first orientation to a receiver whereon a bobbin has a different second orientation, the layers of the stack being separated from each other by sheet-like partitions, comprising:

a first gripper having first jaws receivable in the core of a bobbin and means for moving the jaws relative to the axis of the bobbin into and from engagement with the internal surface of such core, wherein said first jaws are movable at least substantially radially of the axis of a core into engagement with the internal surface of a core at said stack and from engagement with the internal surface of a core at said receiver;

a second gripper having second jaws movable to positions adjacent the external surface of a core and means for moving the second jaws into and from engagement with the external surface of such core;

suction-operated lifting means for attracting a partition upon removal of a layer from the stack;

means for moving the grippers and the lifting means between the stack and the receiver;

means for changing the orientation of said grippers; and a substantially plate-like pusher and means for moving said pusher relative to the first jaws at least substantially axially of the core being engaged by said first jaws between the stack and the receiver, wherein said second jaws are borne by said pusher.

2. The apparatus of claim 1, wherein the webs consist of a wrapping material for smokers' products.

3. The apparatus of claim 1, wherein said means for changing the orientation includes means for pivoting said grippers and said lifting means through at least substantially 90°.

4. The apparatus of claim 1, wherein the axes of bobbins in the stack are at least substantially vertical and the axis of a bobbin on said receiver is at least substantially horizontal.

5. The apparatus of claim 1, wherein at least one of said grippers comprises an array of at least three at least substantially equidistant jaws.

6. The apparatus of claim 1, wherein the receiver is associated with a cigarette packing machine.

7. The apparatus of claim 1, wherein the receiver is associated with a cigarette making machine.

8. The apparatus of claim 1, wherein said first jaws are movable into a core of a bobbin at said stack through a predetermined distance and said pusher is movable relative to said first jaws through a second distance at least approximating said first distance.

9. The apparatus of claim 1, wherein said lifting means is adapted to be movable with said pusher.

10. The apparatus of claim 1, further comprising a common support for said grippers and said lifting means.

11. The apparatus of claim 1, wherein said second jaws are movable against the external surface of the core of an exhausted bobbin at said receiver substantially radially of said external surface and away from the core of the exhausted bobbin at a location remote from the receiver and the stack.

12. A method of manipulating bobbins of the type including a core having an internal surface, an external surface at least substantially coaxial with the internal surface, and a web of convoluted sheet material surrounding the external surface, comprising the steps of:

establishing a stack of a plurality of superimposed horizontal layers of bobbins wherein bobbins have at least substantially vertical axes and wherein the superimposed layers are separated from each other by at least substantially horizontal sheet-like partitions;

gripping the internal surfaces of cores at the stack and transferring the thus gripped cores from the stack to a web processing station with a pusher;

changing the orientation of the axes of bobbins from at least substantially vertical to at least substantially horizontal during transfer from the stack to the processing station;

gripping the external surface of the core of an exhausted bobbin at the station with jaws borne on the pusher and removing such core from the station; and lifting a partition off the stack upon completed transfer of a layer of bobbins from the stack to the processing station.

13. The method of claim 12, further comprising the step of converting the webs of bobbins at said processing station into discrete wrappers for smokers' products.

14. The method of claim 12, further comprising the step of transferring lifted partitions into a receptacle.

15. The method of claim 12, further comprising the step of supporting the core of the bobbin at the processing station from within the core.

16. The method of claim 12, further comprising the step of changing the orientation of the partition upon lifting of the partition off the stack.

17. The method of claim 12, wherein said gripping steps are carried out by sets of equidistant jaws and wherein the movements of jaws carrying out the transfer of bobbins from the stack to the processing station are shared by grippers carrying out said removing step.

* * * * *